United States Patent [19]

Jacobsen

[11] 3,990,371

[45] Nov. 9, 1976

[54] CALIFORNIA TYPE PLATFORM

[75] Inventor: Louis K. Jacobsen, Universal City, Tex.

[73] Assignee: Ewing-Records & Associates, Inc., Converse, Tex.

[22] Filed: May 16, 1975

[21] Appl. No.: 578,205

[52] U.S. Cl. ..... 104/137; 105/161; 238/10 R

[51] Int. Cl.[2] ..... B61B 13/00; B61D 15/00

[58] Field of Search ..... 238/1, 10 R; 104/1 R, 104/48, 137, 3, 4; 61/42, 84; 173/23; 105/7, 177, 159, 161, 364, 371; 254/86 H, 93 R, 93 HP; 280/43.23

[56] References Cited

UNITED STATES PATENTS

| | | | |
|---|---|---|---|
| 763,030 | 6/1904 | Thompson | 61/84 |
| 2,889,685 | 6/1959 | Pickman | 105/159 X |
| 2,907,481 | 10/1959 | Russell | 104/137 X |
| 3,138,327 | 6/1964 | Jacobs | 238/10 R |
| 3,365,895 | 1/1968 | Jacobs | 238/10 R X |
| 3,626,855 | 12/1971 | Fogelstrom | 61/84 X |
| 3,678,694 | 7/1972 | Haspert | 61/84 |
| 3,829,116 | 8/1974 | Burdick | 280/43.23 |

*Primary Examiner*—L. J. Paperner
*Assistant Examiner*—Randolph A. Reese
*Attorney, Agent, or Firm*—W. F. Hyer; Marvin B. Eickenroht

[57] ABSTRACT

A California type platform having an elongate frame which may be raised above the platform by wheels carried by the frame in position to be forced downwardly against the tunnel track by means of inflatable air bags.

10 Claims, 10 Drawing Figures

50
53
54
49
48
51a
39
37
44
30
62
51b
27
56
58
26
42
55
45
38
60
41
7
8
40
61
37
27
7
8

38
36
30
46
45
39
41
27
39
58
47
55
56
42
26
52
46
43
51
44
25
27
22

CALIFORNIA TYPE PLATFORM

This invention relates to improvements in platforms of the so-called "California" type which are used to support a rail car above track laid along the bottom of a tunnel.

As well known in the art, platforms of this type comprise an elongate frame having track on its top deck and adapted to be supported by the tunnel on opposite sides of tunnel track. More particularly, the platforms are adapted to be arranged in end-to-end relation, and are provided with rails which form passing track disposed in a relatively wide portion of the tunnel above the single tunnel track laid along its bottom. Thus, the platforms provide a means by which rail cars may pass other cars in the tunnel, as may be required in moving pay load from the tunnel.

The platforms are adapted to be raised above supported positions to permit them to be towed to different positions along the tunnel. For this purpose, wheels are pivotally mounted on the frame for swinging between raised positions to permit the frame to be supported on the tunnel, and lowered positions in which they are forced against the tunnel track to raise the platforms from support by the tunnel.

In prior platforms of this type, the wheels have been so mounted by means of cranks connected to linkage extending from one platform to the other. More particularly, the linkage has comprised a pair of rods each extending from an hydraulic actuator located on a central platform. Thus, the rods may be reciprocated to swing the wheels between their raised and lowered positions so as to raise and lower the platforms simultaneously with one another. The use of the centrally located hydraulic actuator was also intended to reduce the cost of the system, especially in view of the inaccessability of hydraulic power in the tunnel.

A system of this type has several shortcomings, in addition to being heavy and expensive to manufacture. Thus, the rods may foul other parts on the decks of the platforms, particularly those on which single or transition track are mounted. Furthermore, since the linkage holds the wheels in lowered position under pressure, the end-to-end spacing of adjacent platforms cannot be adjusted to facilitate traversing small radius curves in the tunnel. Still further, pressure from the hydraulic system must be maintained on the actuator in order to maintain the platforms raised as they are towed to different locations.

An object of this invention is to provide a California platform having a system for raising and lowering the wheels which is lighter and less expensive to manufacture, and further which requires less attention, than that above described.

Another object is to provide such a California platform in which there are no parts which may foul track or other equipment on the top deck of the platform.

A further object is to provide a California platform whose ends are connectable to the ends of adjacent platforms as to permit them to traverse relatively small radius curves.

Still another object is to provide a California platform having a simple and inexpensive mechanism for locking the wheels in lowered positions even though fluid pressure used to lower them might be lost.

These and other objects are accomplished, in accordance with the illustrated embodiment of the invention, by a platform of the type described wherein each wheel is caused to move between raised and lowered positions by means of an actuator arranged between the frame and a pivotally mounted arm on which the wheel is carried. In this way, the above-described linkage, and its attendant problems, may be avoided. More particularly, each actuator comprises a bag which may be pneumatically inflated by sources of compressed air normally present in tunnels to force the wheels downwardly against the tunnel track in order to lift the frame from the tunnel, whereby it may be towed to a different location therealong, and then deflated to permit the wheels to be raised to a level at which the frame is lowered back into supported position on the tunnel.

In the illustrated and preferred embodiment of the invention, manifolding and flexible hoses are provided to permit each of several, and preferably all, bags on each platform to be inflated by the same source and both bags for actuating laterally spaced pairs of wheels to be inflated or deflated at substantially the same time in response to a single manipulation. Thus, in addition to being relatively light and inexpensive to manufacture, the bags require a minimum of attention.

Since there is no linkage, the top deck is clear of the major obstructions which might foul the track or other equipment on the top deck of the platform. In addition, each bag is arranged beneath the top deck of the platform so as to further eliminate obstructions. Preferably, each bag is arranged between the arm on which the wheel is mounted and the top wall of a housing having side walls fittable within openings in the top deck of the frame of the platform, and releasably mounted therein with its top wall forming part of the top deck of the platform. Each arm is swingably carried by the housing by means of a rod which extends between and is pivotally mounted from the side walls of the housing.

The ends of adjacent platforms are releasably connectable to one another in alternate positons — either close to one another, when the platforms are in stationary positions in the tunnel, or spaced apart to permit the platforms to be arranged at relatively large angles with respect to one another, and thereby facilitate traversing small radius curves when the platforms are moved along the tunnel track. More particularly, the ends of the platforms are so connected by a tow bar having holes therein alignable with holes in the ends of the platforms so as to receive pins therethrough, with certain of the holes being spaced longitudinally of others to permit the effective length of the bar to be varied. In addition, guide pins and sockets are provided on the ends of the platforms outboard of the tow bar connecting means for closely interfitting with one another when the ends of the platforms are spaced apart, and thereby restraining the ends of the platforms, when close to one another, from relative movement, vertically, horizontally or angularly.

A means is also provided for locking each wall in its lowered position so that the bags may be deflated while the platform is held in a raised position above the tunnel. This locking means comprises a rod pivotally mounted on the frame for swinging about an axis parallel to the pivotal axis of the arm, and a lock part carried by the rod and having a locking surface so arranged that, when the arm is lowered, the rod may be swung to move the lock part between the unlocking position in which it is above the top side of the arm when raised, and a locking position in which the locking surface is moved to the side of a plane extending through the pivotal axis of the rod and perpendicular to the top side of the arm away from the pivotal axis of the arm. More particularly, means are provided on the frame to prevent swinging of the locking part past its locking position so that, as above mentioned, the locking surface is retained in engagement with the top side of the arm thereof even through the bag may be deflated.

In the drawings, wherein like reference characters are used throughout to designate like parts:

Figure 1:
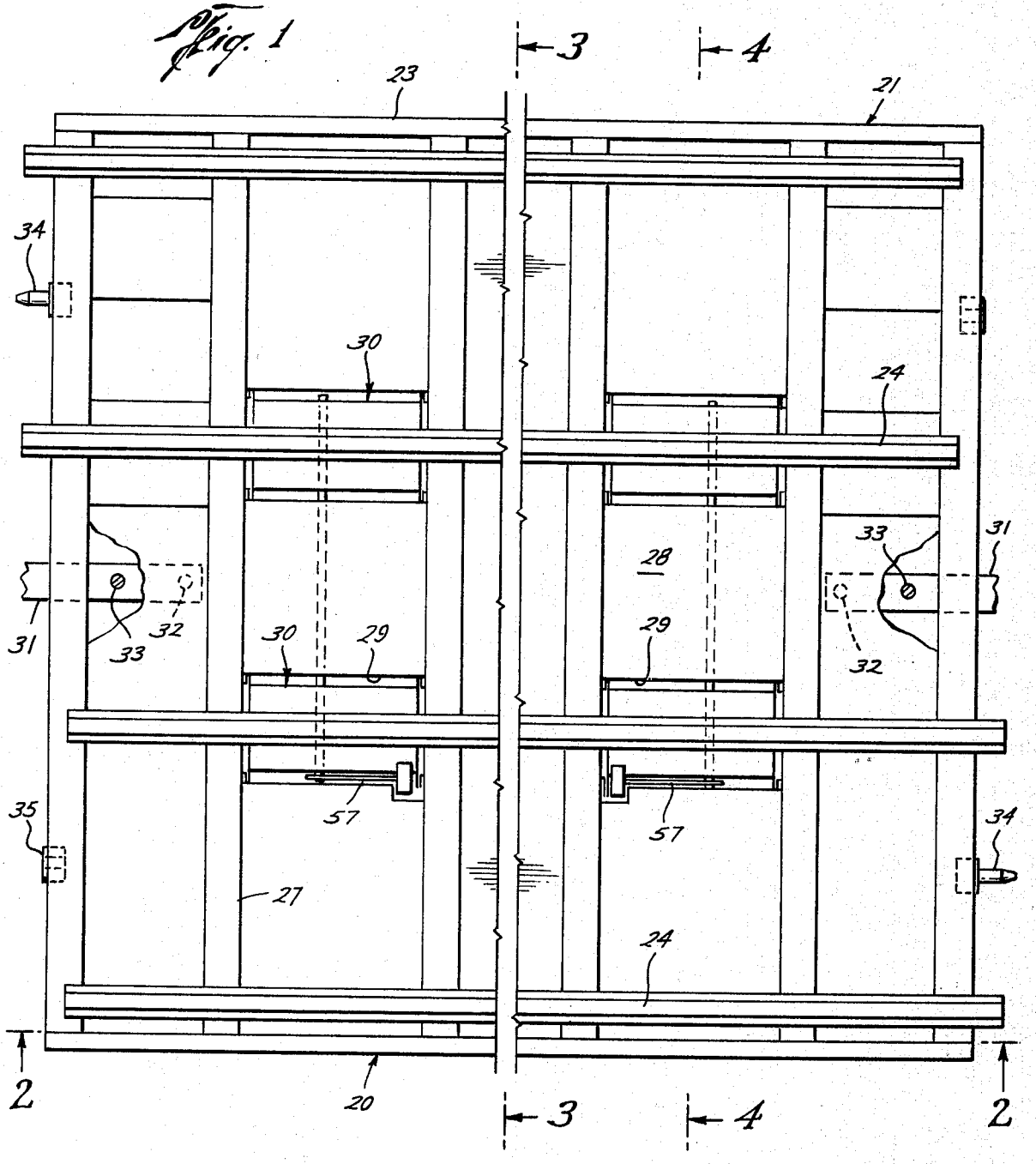
FIG. 1 is a longitudinally discontinuous plan view of a platform constructed in accordance with the present invention.
Figure 2:
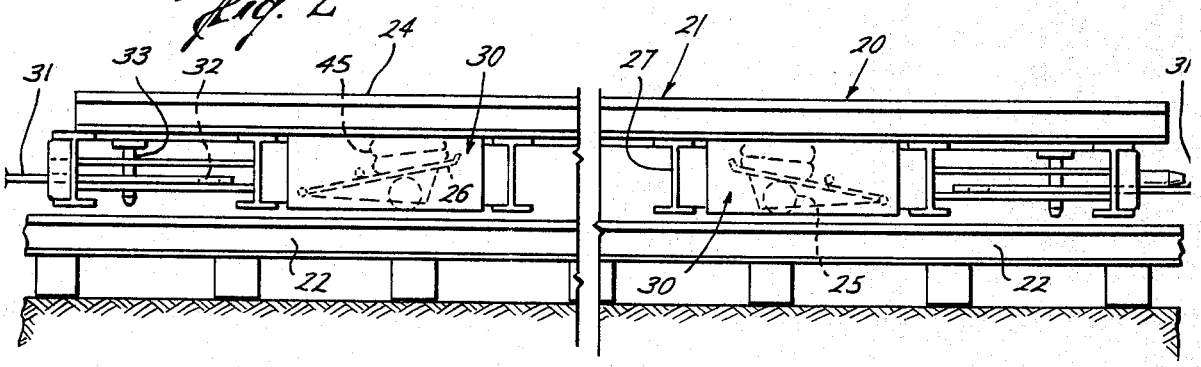
FIG. 2 is a side view of the platform of FIG. 1.
Figure 3:
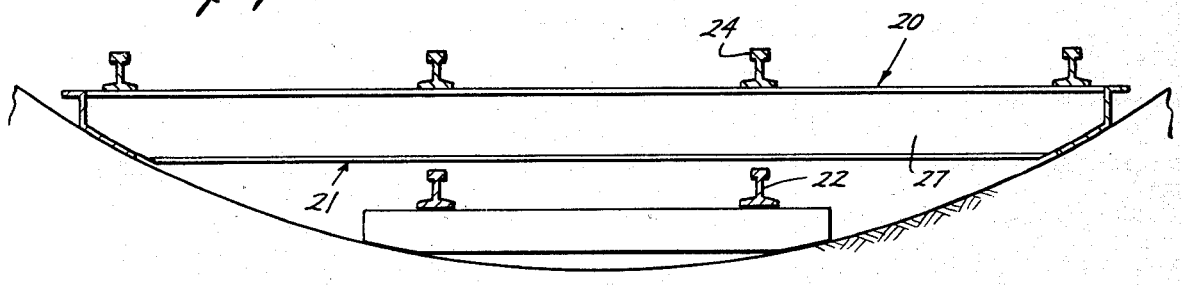
FIG. 3 is a cross-sectional view of the platform, as seen along broken line 3—3 of FIG. 1, with the frame thereof supported by the sides of the tunnel in which the platform is disposed.
Figure 4:
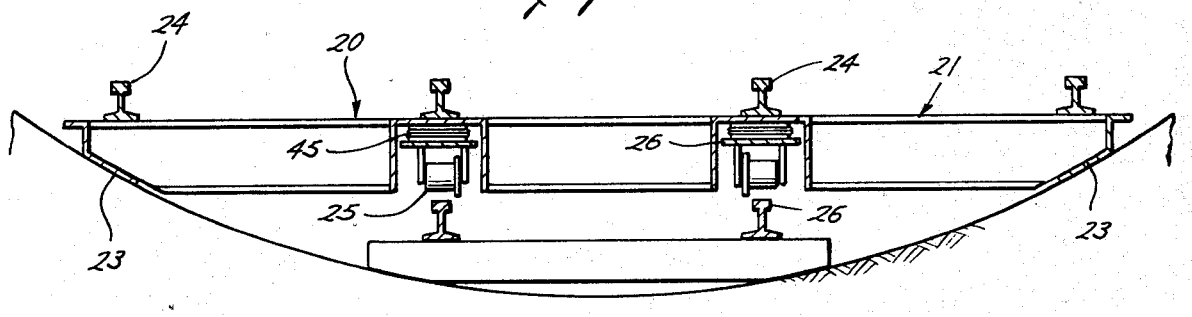
FIGS. 4 and 5 are cross-sectional views of the platform, as seen along broken line 4—4 of FIG. 1, with the platform shown supported on the tunnel in FIG. 4, and lifted above the tunnel in FIG. 5.
Figure 5:
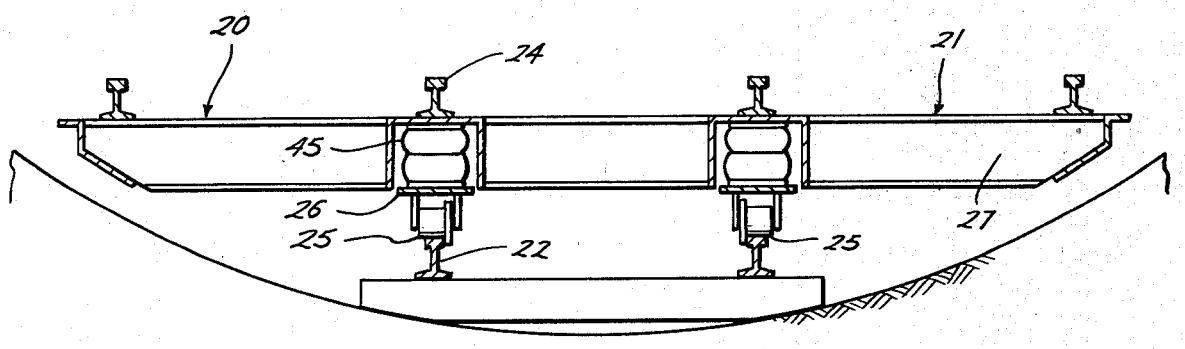

With reference now to the details of the above-described drawings, the overall platform, which is indicated in its entirety in FIGS. 1 to 5 by reference character 20, comprises a rigid elongate frame 21 adapted to be disposed above track 22 laid on ties arranged along the bottom of the tunnel. More particularly, and as shown in FIGS. 3 to 5, the platform is of such width as to be supportable at its opposite sides 23 on the tunnel when the lowered position of FIGS. 2, 3 and 4.

As previously described, track is laid longitudinally along the top side of the frame for supporting a rail car (not shown) above the tunnel track 22. The number and relative lateral spacing from the platform track will depend upon whether the platform is at or near the end of an assembly of platforms or at an intermediate portion thereof. In the former case, there may be only a single track, or possibly portions of a frog, on the top side of the frame, while in the latter case, there will normally be a pair of side-by-side tracks. For purposes of illustration, the platform 20 is one adapted to be connected at an intermediate portion of the assembly, so that there are a pair of tracks 24 laid along its top side.

Wheels 25 are mounted on arms 26 pivotally supported on the platform for movement between raised positions when the platform is supported on the sides of the tunnels, as shown in FIGS. 2, 3 and 4, and lowered positions for pushing against the tunnel track 22 so as to lift the frame from the tunnel, as shown in FIG. 5. As previously described, in the former position, the tracks 24 on the frame are adapted to support rail cars for storage and/or movement into and out of the tunnel, and more particularly to permit rail cars on one of the tracks to be moved past those on the other. On the other hand, when the rail cars are removed from the platform, and the frame is raised, as shown in FIG. 5, the platform is in a position to be moved longitudinally along the tunnel track 22 for relocation therein.

As will be appreciated, the wheels 25 are normally located in sets of longitudinally spaced-apart pairs, with the wheels of each pair being laterally spaced apart. As shown, each pair of wheels is located midway of the sides of the frame, and the pair of tracks 24 are equally spaced on opposite sides of the longitudinal centerline of the frame.

The sides 23 of frame 21 are connected by cross members 27 which, as shown, comprise I-beams, and a top deck 28 extends across the top of the frame between the side and cross members to provide working areas on the platform. As best shown in FIG. 1, openings 29 are provided within the deck to receive housings 30 for the wheel assemblies, the housings being releasably mounted in the openings to form part of the frame, in a manner to be described.

Tow bars 31 are releasably secured to the ends of adjacent platforms so as to permit the platforms to be connected, as previously mentioned, either close together or spaced apart. More particularly, and as shown in FIGS. 1 and 2, each tow bar has a pair of longitudinally spaced holes 32 formed toward each end thereof, and the end of the frame of each platform has a hole formed therein midway its opposite sides to that when the hole in the end of the frame is aligned with one of the holes at the adjacent end of tow bar 32, a pin 33 may be received therethrough to releasably connect the tow bar to that end of the platform. Since the pair of holes on the tow bar are longitudinally spaced, alignmnt of the inboard holes of the tow bar with the holes in the adjacent ends of the platform will connect the platforms with their ends close together, while alignment of the outboard holes with the holes in the ends of the platform will connect them with their ends spaced apart.

As also shown in FIGS. 1 and 2, a pin 34 extends longitudinally from each end of the frame of the platform on one lateral side of tow bar 31, and a guide socket 35 extends longitudinally of each end of the frame an equal distance on the other side of the tow bar. With the frames releasably connected with their ends close together, their guide pins and sockets closely interfit with one another so as to prevent relative movement between the frames, either horizontally, vertically or angularly. On the other hand, when the effective lengths of the tow bars 31 are extended by alignment of the outermost holes 32 therein with the holes in the adjacent ends of the platform frames, so as to space the adjacent ends of the platforms apart, the guide pins 34 are removed from the sockets 25 so as to permit the frames to be angled with respect to one another, as above described.

As shown in FIGS. 6 to 10, each housing 30 is a box-like construction comprising top wall 36, side walls 37 and end walls 38. For purposes of illustration, adjacent portions of the deck 28 of the platform have been removed from FIGS. 6 to 10, although it is apparent that with the housing 30 mounted in an opening 29 in the deck of the platform, the top wall 36 of the housing forms a substantial horizontal continuation of the portion of the remainder of the deck surrounded in the opening. The side and end walls of the housing extend downwardly to a depth corresponding substantially to the height of the I-beams 27 and thus the height of the overall frame.

Figure 6:
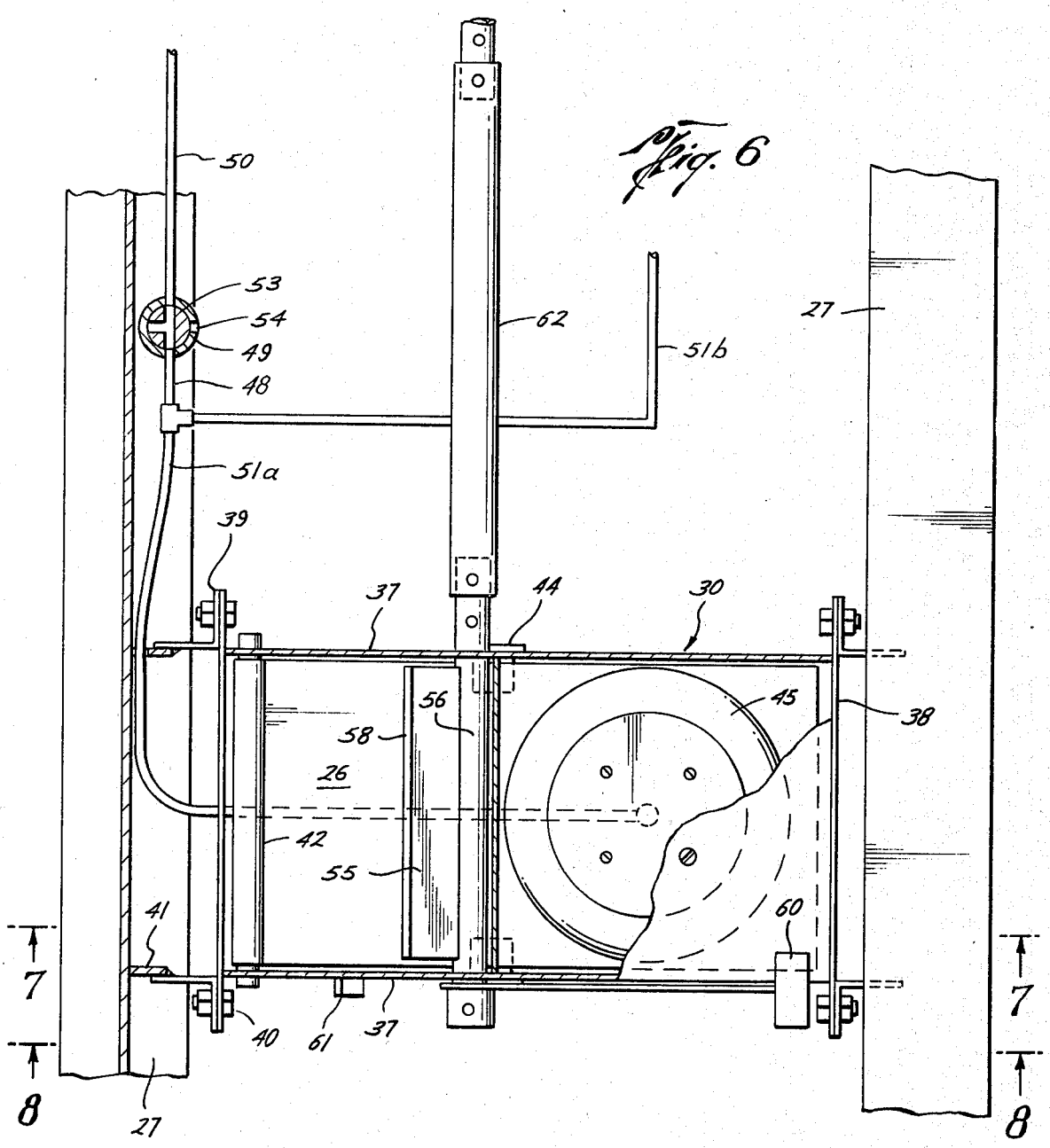
FIG. 6 is an enlarged plan view of a portion of the platform, broken away in part to show a bag and an arm on which one of the wheels is mounted.

Each housing is removably mounted within a hole 29 in the deck of the platform by bolts 40 which secure lateral extensions of each end of said wall 38 to angles 39 welded to flanges 41 on the inner sides of I-beams at each end of the opening. Thus, as best shown in FIG. 6, flanges on the inner ends of the angles are disposed within opening 29 and have bolt holes therethrough for alignment with bolt holes in adjacent faces of the extensions of side walls, whereby, during assembly of the platform, or in order to replace an assembly 30, it is merely necessary to lower it into a hole 29, and then secure it to angle 39 by means of bolts 40.

Figure 7:
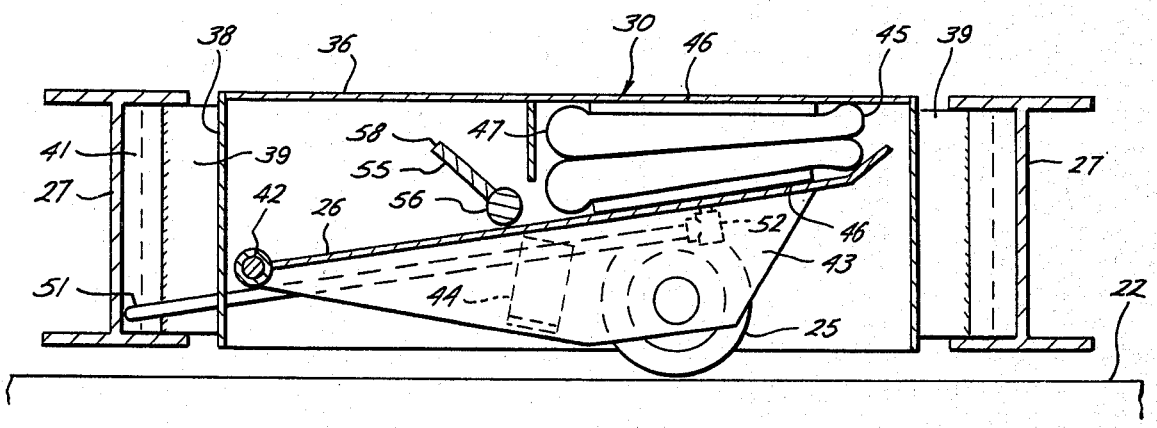
FIG. 7 is a vertical sectional view of the portion of the platform shown in FIG. 6, as seen along broken line 7—7 thereof.
Figure 8:
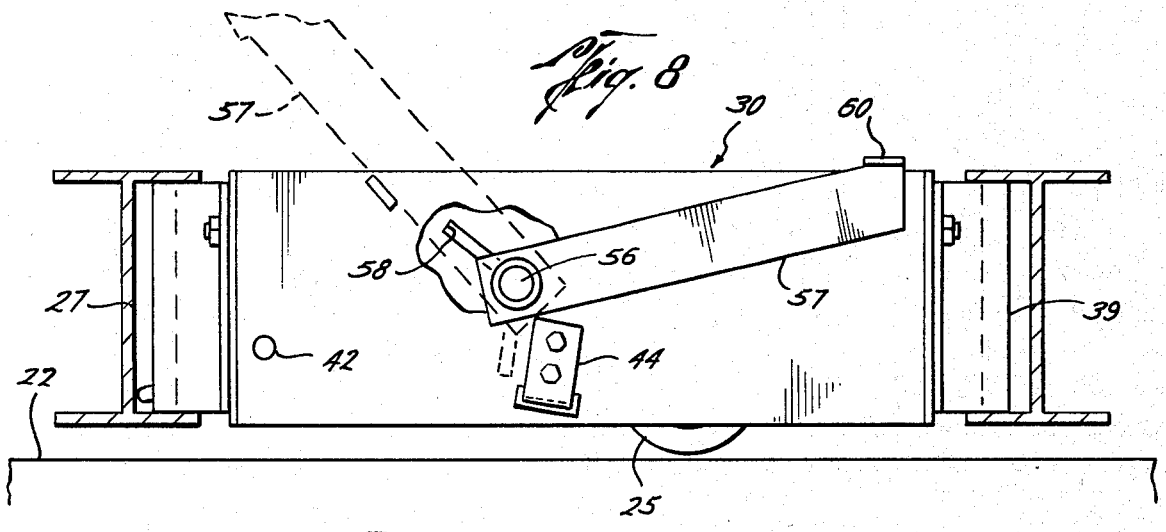
FIG. 8 is another vertical sectional view of the platform portion, as seen along broken line 8—8 of FIG. 6.
Figure 9:
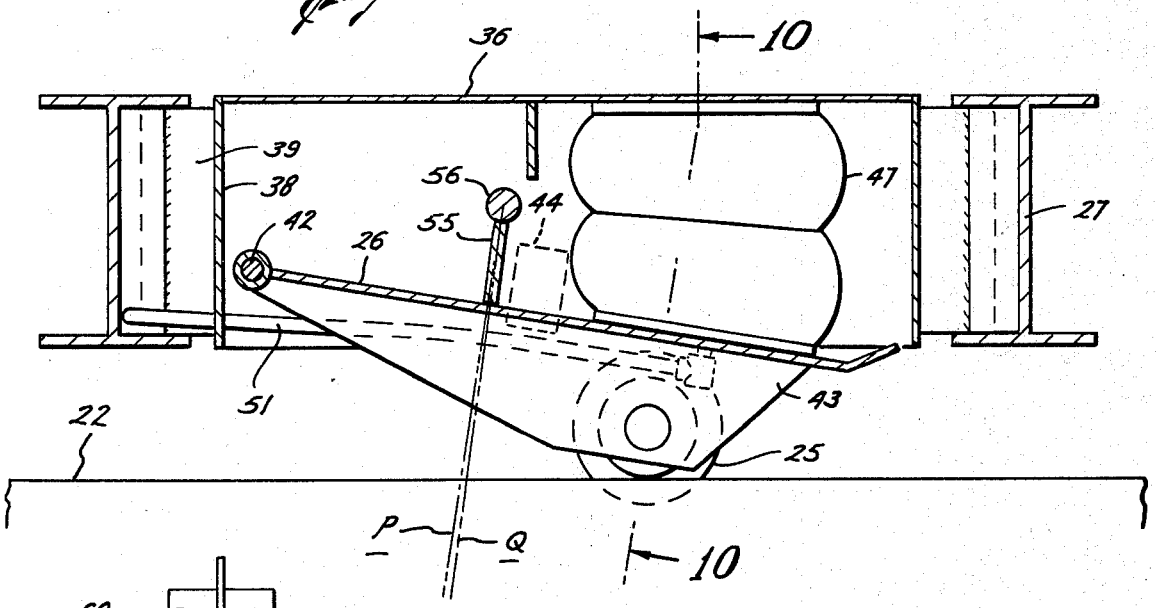
FIG. 9 is a vertical sectional view similar to FIG. 7, but upon inflation of the bag to move the arm and wheel downwardly to a position for lifting the platform above the tunnel track.
Figure 10:
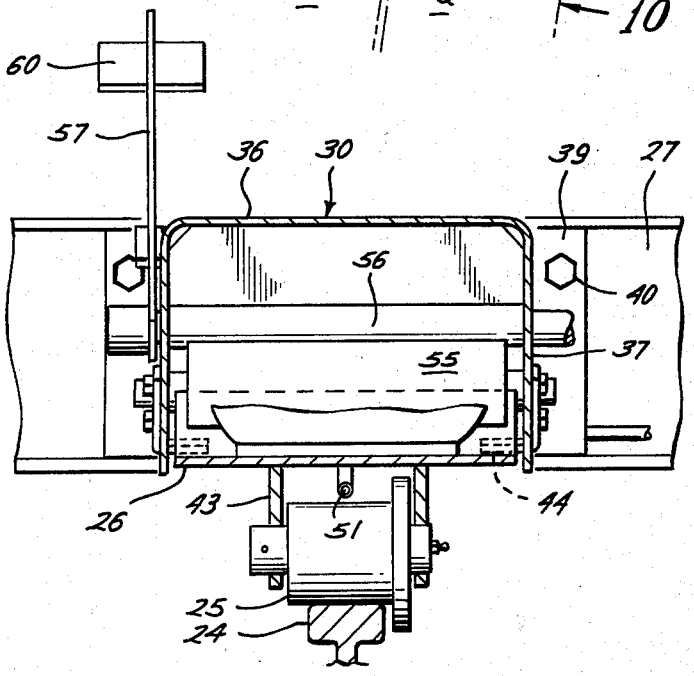
FIG. 10 is a cross-sectional view of the bag, arm and wheel, as seen along broken line 10—10 of FIG. 9.

As best shown in FIGS. 6 to 10, each arm 26 is fixed to a rod 42 which extends between and is journaled in the opposite side walls 37 of housing 30 for pivoting about a transverse axis. Flanges 43 are mounted on and extend downwardly from the lower side of arm 26 so as to rotatably support the axle of wheel 25 therebetween, as best shown in FIG. 10. When the arm is swung upwardly to its raised position, as shown in FIGS. 7 and 8, the lower end of the wheel 25 extends only a short distance beneath the lower edge of the housing 30, as determined by the spacing between the bottom of the frame and the tunnel track 22 when the frame is supported on the tunnel. On the other hand, when the arm 26 is swung downwardly, it pushes wheel 25 against track 2 so as to lift the platform from supported position on the tunnel, the extent of lifting being limited by engagement of the lower side of the arm with the horizontal flanges of angles 44 which are secured to the side walls of the housing.

As previously described, each arm 26 and wheel mounted thereon is moved from raised to lowered position so as to lift the frame from the tunnel by inflation of an air bag 45 arranged between top wall 36 of housing 30 and the top side of the arm. Of course, upon deflation of the bag, the arm and wheel are free to swing upwardly to permit the frame to drop downwardly to supported position on the tunnel. Each such air bag 45 may be of conventional construction having rigid plates 46 at its opposite ends for connection to the housing top wall and arm, and a plurality of collapsible and expandible convolutions 47 intermediate its ends 46. Air bag actuators of a type found to be suitable for this purpose are manufactured by the Firestone Industrial Products Company of Noblesville, Ind.

As previously described, one advantage of using air bags as actuators is the availability of compressed air as a source of power in most tunnels. As also previously described, this invention contemplates that several and preferably all bags on each platform may be inflated from the same source, and that the bags for actuating laterally spaced pairs of wheels 25 may be inflated or deflated by the same control mechanism. Thus, as shown in FIG. 6, a flexible conduit 50 connected to a supply line (not shown) which extends along one side of the platform and is connected to the source of compressed air (not shown), is in turn connected to one side of a manifold valve 49 mounted adjacent one end of the frame. A flexible conduit 48 connected with the other side of the manifold is connected by a Tee to flexible conduits 51*a* and 51*b* which connect with the interior of one of the pair of bags 45 at the end of the platform frame near valve 49. Thus, as shown in FIG. 7, conduit 51*a* connects with a fitting 52, leading to the interior of the lower end of bag 45.

As shown in FIG. 6, a rotatable plug 53 of manifold valve 49 has ports therein arranged as a Tee so as to connect the source of compressed air with conduit 48, and thus with conduits 51*a* and 51*b*, in the position of the plug shown in FIG. 6. However, as will be understood, upon rotation of the plug ninety degrees in a counterclockwise direction, the compressed air in conduits 51*a* and 51*b* will be exhausted through port 54 in the casing of the manifold valve so as to permit the bags 45 to deflate, and thus each platform to move downwardly to supported position. If all the bags on all platforms are connected with the same source of compressed air, as is preferred, the entire assembly of the platforms is raised and lowered substantially simultaneously. In any event, however, the connection of the adjacent ends of the platforms will cause than to be maintained in end-to-end alignment so as to avoid injury to the track.

As previously described, each wheel is adapted to be locked in its lower position by locking means which comprises a locking part 55 carried by a rod 56 mounted on the housing for swinging betweeen locking and unlocking positions in response to manipulation of handle 57 extending from the rod 56. As shown, locking part 55 comprises a bar exending longitudinally of rod 56 and having a locking surface 58 on its outer end, and rod 56 extends between and is journaled at its opposite ends by the side walls 37 of housing 30 above the arm 26. In its unlocking position, the locking bar 55 is above the arm 26 so that the arm is free to swing upwardly to its raised position, as shown in FIG. 7. In its locking position, the bar 55 extends downwardly substantially perpendicularly to the top of arm 26, when the arm is swung downwardly to lower the wheel 25 into frame supporting position, to dispose locking surface 58 substantially flush with the top surface of arm 26.

Handle 57 for swinging locking part 55 between its unlocking and locking positions is connected to rod 56 on the outer side of a side wall 37 of the housing. More particularly, the handle projects through a slot in the deck adjacent the opening 29 in which the housing 30 is received so as to extend above the top deck of the platform as it swings between the solid line position of FIG. 8, in which it has moved the locking part to the unlocking position shown in FIG. 7, and the broken line position of FIG. 8, in which it has moved the locking part 55 to a locking position of FIG. 9. Thus, the upper end of the handle is at a readily accessible location for manipulation for a person standing on the top deck.

As previously described, and as shown in FIG. 9, when locking part 55 is in locking position, its locking surface has moved to a position in which it is just to a side of a plane P passing through the access of rod 56 and perpendicularly to the top of arm 26 which is away from the pivotal axis of rod 42. In other words, the locking surface has moved over "dead center" in swinging in a counterclockwise direction from its unlocking to its locking position so that a plane Q passing through the axis of rod 56 and midway of the sides of part 55 is just to the right of plane P. In this manner, it is possible to first inflate bags 45 so as to lower the wheels into frame supporting position, and then swing handle 57 in a counterclockwise direction, as shown in FIG. 8, so as to move the locking part 55 into the locking part position of FIG. 9, whereby the wheels will be maintained in supporting position even upon deflation of the bags, which may occur accidentally as upon loss of pressure source.

Handle 57 is located in and prevented from swinging beyond the unlocking position by engagement of the inner side of a flange 60 into its outer end with the top side of housing 30. In this position of the handle, the center of gravity of the handle and the locking position is to the right of the axis of rod 56, as shown in FIG. 8, so that there is no tendency for the rod to swing back in a counterclockwise direction toward its unlocking position. However, when the wheel 25 has been lowered and it is desired to move the handle into locking position, it need only be grasped by the flange 60 and pulled upwardly in a counterclockwise direction until the top edge of the handle comes to rest upon a stop plate 61 mounted on the adjacent outer side 37 of the housing 40. As previously described, in moving into its locking position, the locking part has moved over dead center, as best shown in FIG. 9. In this position, the center of gravity of the handle and locking part is to the left of the rod 56, as shown in FIG. 8, so that there is no tendency for the handle to swing back in a clockwise direction. As previously described, upon deflation of the bag 45, the top side of the arm will be forced tightly against the locking surface 58 on the end of the locking part 55. Then, of course, in order to permit the locking part to be returned to its unlocking position, it is only necessary to reinflate the bag to force wheel 25 downwardly a slight extent in order to permit the locking part 55 to be moved back over dead center in a clockwise direction.

As also previously described, rods 56 of each laterally spaced pair of housings extend beyond the inner side walls of the housing and are connected to one another, as by means of a sleeve 62 shown in FIG. 6, whereby the locking parts of both such housings may be swung between locking and unlocking position by means of only one handle 57. The outwardly extending ends of rods 56 may be releasably connected to the sleeve 62 in any suitable manner, such as pins extending through holes in the sleeve and rods.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. A platform for use in supporting a rail car above track laid along the bottom of a tunnel, said platform comprising an elongate frame adapted to be supported by the sides of the tunnel on opposite sides of the tunnel track, track extending longitudinally of the top deck of the frame to support such rail car, a plurality of arms each pivotally mounted on the platform for swinging about an axis generally perpendicular to the track, a wheel carried on each arm in position to engage the tunnel track, means including a pneumatically inflatable bag arranged between each arm and the frame for swinging each arm about its axis, when so inflated, to force said wheels downwardly against said tunnel track and thereby lift said frame from the tunnel, whereby it may be towed to a different location along the tunnel, each said bag, when deflated, permitting said arm to swing in the opposite direction in order to raise the wheels to a level at which the frame is lowered back into supporting position on the tunnel, and means for so inflating and deflating the bags.

2. A platform of the character defined in claim 1, including means mounted on the frame to engage each arm in order to limit its downward swinging.

3. A platform of the character defined in claim 1, wherein said bags are arranged between the top deck of the frame and each arm.

4. A platform for use in supporting a rail car above track laid along the bottom of a tunnel, said platform comprising a frame adapted to be supported by the sides of the tunnel on opposite sides of the tunnel track, track extending longitudinally of the top deck of the frame to support such rail car, a plurality of arms each pivotally mounted on the platform for swinging about an axis generally perpendicular to the track, a wheel carried on each arm in position to engage the tunnel track, means including a fluid actuator arranged between each arm and the frame for swinging said arm about its axis from a first position in which the wheel is free to rise to a level to permit the frame to be supported by the tunnel, to a second position in which said wheel is forced downwardly against the tunnel track to lift the frame from the tunnel, whereby it will be towed to a different location along the tunnel, a rod pivotally mounted on the frame for swinging about an axis parallel to the pivotal axis of said arm, a lock part carried by the rod and having a locking surface so arranged that, when the arm is in its second position, the rod may be swung to move said lock part between an unlocking position in which it is raised above the top side of the arm in its first position, and a locking position in which said locking surface is moved to the side of a plane extending through the pivotal axis of the rod and perpendicular to said top side away from the pivotal axis of said arm, and means on the frame to prevent swinging of the lock part past its locking position, whereby, upon the relief of fluid from the actuator to permit the arm to swing back toward its first position, the top side of said arm is engaged by said locking surface to maintain it forced downwardly against the tunnel track.

5. A platform of the character defined in claim 4, including a handle on the rod having a free end which extends above the top deck as the lock part is swung between locking and unlocking positions.

6. A platform of the character defined in claim 4, wherein the wheels are arranged in longitudinally spaced-apart sets, each set including at least two laterally spaced-apart wheels, and the rods for swinging arms on which laterally spaced wheels are carried are connected so as to permit them to be swung by a single handle.

7. An assembly for use in raising and lowering a platform adapted to support a rail car above track laid along the bottom of a tunnel, said assembly comprising a housing having a top wall and side walls, a first rod extending between and pivotally mounted on the side walls of the housing, an arm on the rod, a wheel carried on the arm for swinging therewith between a raised and lowered position, a pneumatically inflatable bag arranged between the top wall of the housing and the arm so that, when so inflated, it swings the arm downwardly to move said wheel to its lowered position, a second rod extending between and pivotally mounted on the side walls of the housing above the arm, a locking bar carried by the second rod and having a locking surface so arranged that when the arm is in its second position, the rod may be swung to move said lock part between an unlocking position in which it is raised above the top side of the arm in its first position, and a locking position in which said locking surface is moved to the side of a plane extending through the pivotal axis of the rod and perpendicular to said top side away from the pivotal axis of said arm, and means on the frame to prevent swinging of the bar past its locking position, whereby, upon the relief of fluid from the actuator to permit the arm to swing back toward its first position, the top side of said arm is engaged by said locking surface to hold it in a lowered position.

8. An assembly of the character defined in claim 7, wherein the means for swinging the second rod comprises a handle having a free end extending above the top wall of the housing as the lock part is swing between locking and unlocking positions.

9. An assembly of the character defined in claim 8, wherein the handle includes a part which rests upon the top wall of the housing to locate the locking part in its unlocking position.

10. Apparatus for use in supporting a rail car above track laid along the bottom of a tunnel, said apparatus comprising a plurality of platforms each including an elongate frame adapted to be supported by the sides of the tunnel on opposite sides of the tunnel track, track extending longitudinally of the top deck of the frame to support such rail car, a plurality of arms each pivotally mounted on the platform for swinging about an axis generally perpendicularly to the track, a wheel carried on each arm in position to engage the tunnel track, means including an actuator arranged between each arm and the frame for swinging each arm about its axis between a first position in which the wheel thereon is raised to permit the frame to be supported by the tunnel, and a second position in which the wheel is forced downwardly against said tunnel track to lift said frame from the tunnel, whereby it may be towed to a different location along the tunnel, a tow bar, and means on the tow bar and on the end of each platform near its longitudinal center line for releasably connecting the adjacent platforms with their ends close to one another, or with their ends spaced apart to permit the platforms to be angled with respect to one another, and pins and sockets on the ends of the platforms outboard of the tow bar connecting means which are longitudinally and closely interfittable when the ends of the platforms are close to one another and disengageable from one another when the ends of the platforms are spaced apart.

* * * * *